US005144781A

United States Patent [19]

Fitzner

[11] Patent Number: 5,144,781

[45] Date of Patent: Sep. 8, 1992

[54] DOUBLE FLOOR FOR REMOVING AIR FROM ROOMS

[75] Inventor: Klaus Fitzner, Betzdorf, Fed. Rep. of Germany

[73] Assignee: Heinrich Nickel GmbH, Betzdorf, Fed. Rep. of Germany

[21] Appl. No.: 618,530

[22] Filed: Nov. 26, 1990

Related U.S. Application Data

[63] Continuation of Ser. No. 270,956, Nov. 14, 1988, abandoned.

[30] Foreign Application Priority Data

Nov. 12, 1987 [DE] Fed. Rep. of Germany ..... 3738444

[51] Int. Cl.[5] ..... F24F 7/007

[52] U.S. Cl. ..... 52/303; 454/187

[58] Field of Search ..... 52/302, 303, 126.1, 52/126.5, 126.6, 305; 98/33.1, 31.5, 31.6, 34.5, 34.6, 36

[56] References Cited

U.S. PATENT DOCUMENTS 2,292,665 8/1942 Schneible .
3,158,457 11/1964 Whitfield ..... 98/31.5
3,252,400 5/1966 Madl, Jr. ..... 98/33.1
3,487,766 1/1970 Wood ..... 98/31.5
3,657,991 4/1972 Oberg ..... 98/33.1
3,946,645 3/1976 Evans ..... 98/33.1
4,775,001 10/1988 Ward et al. ..... 98/31.5

FOREIGN PATENT DOCUMENTS 231660 2/1964 Austria .

*Primary Examiner*—Michael Safavi
*Attorney, Agent, or Firm*—Akoo-Toren

[57] ABSTRACT

A double floor for removing air from rooms, particularly clean rooms, which are connected to the air supply system of a ventilating and/or air-conditioning unit. The double floor has an upper floor plane formed by perforated plates. The perforated plates are supported by support members. On the underside of the perforated plates is provided a stiffening system composed of stiffening members. Cover members are provided on portions of the stiffening system facing away from the perforated plates. The cover members form at least in the regions of the edges of the stiffening members nozzle openings which project beyond the lower plane of the stiffening system. All the nozzle openings open in the same direction.

14 Claims, 6 Drawing Sheets

2
4
4
4
1
7
7
7
7
7
6
6
26
3
5

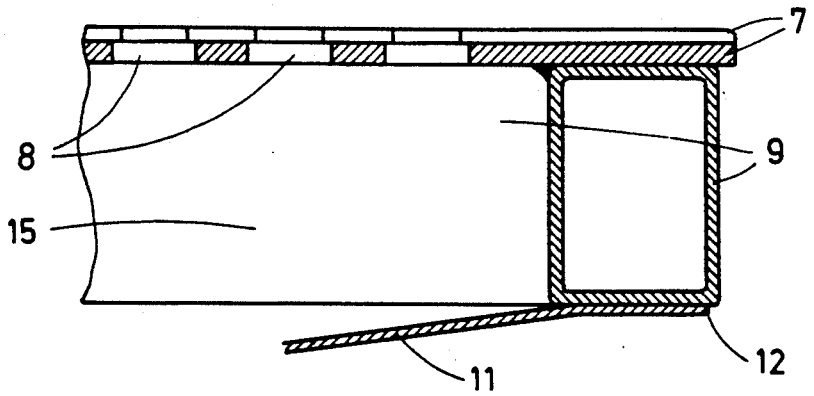
Fig. 3
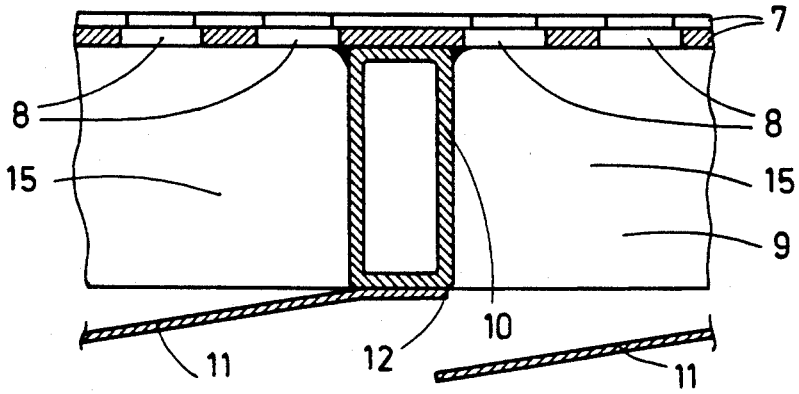
Fig. 4
Fig. 2
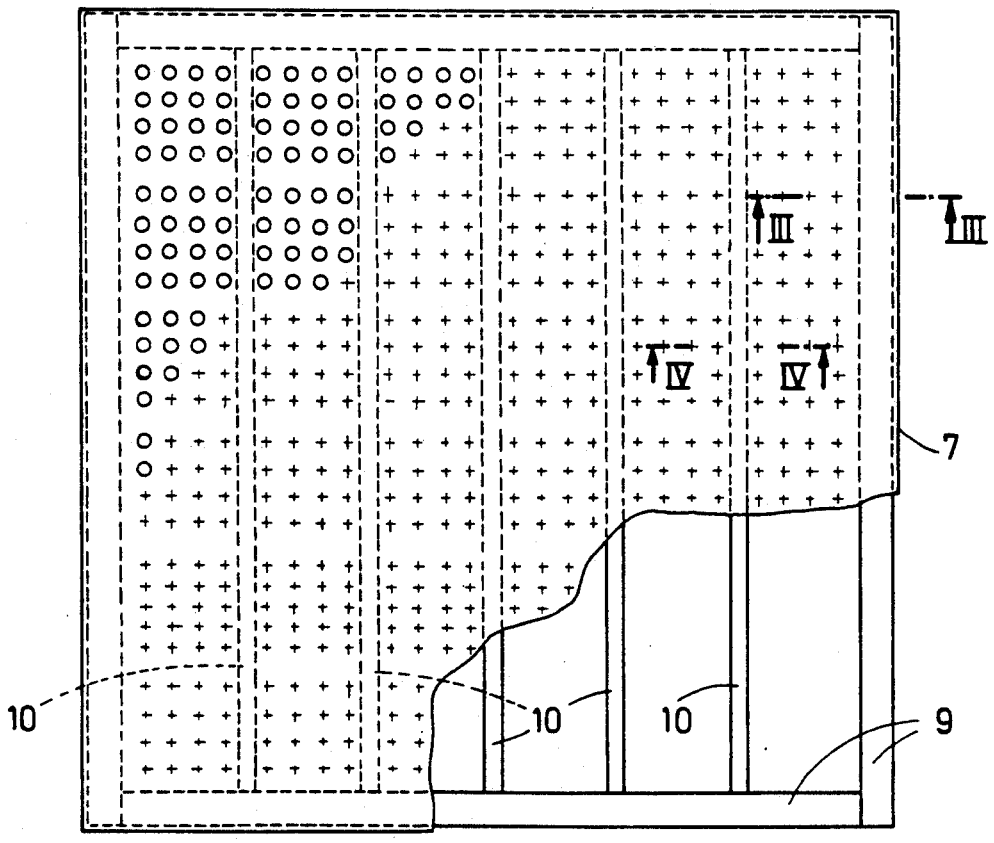

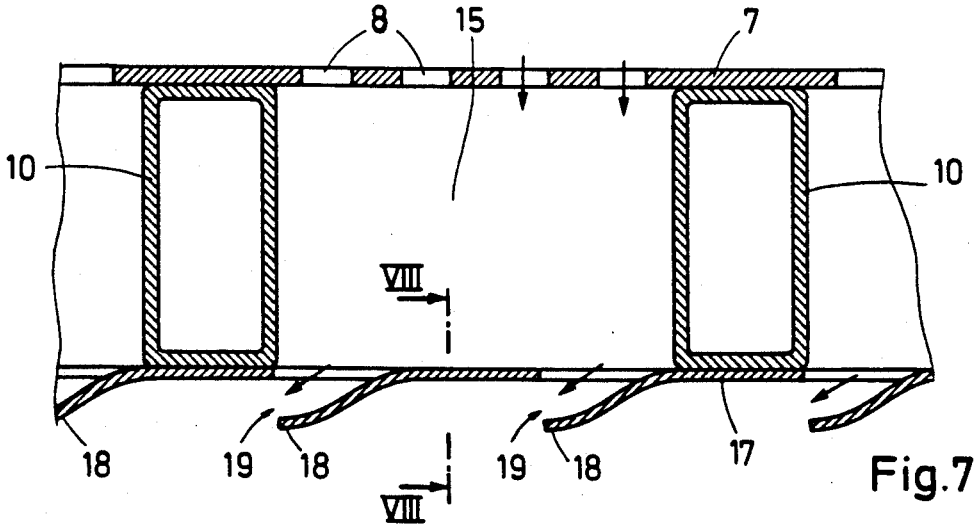
Fig.7
Fig.8
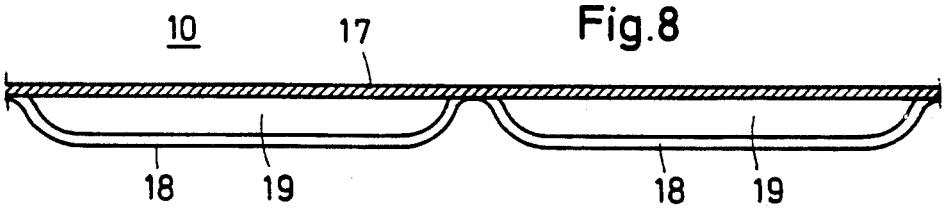
Fig.9
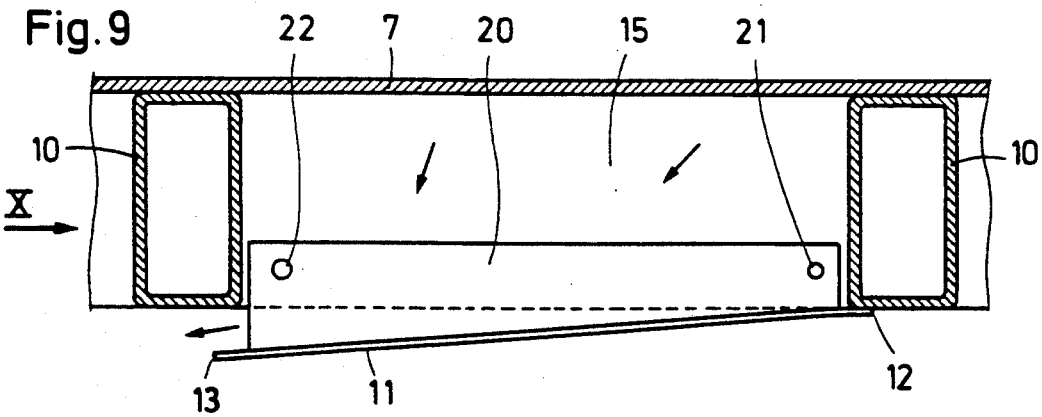
Fig. 10a
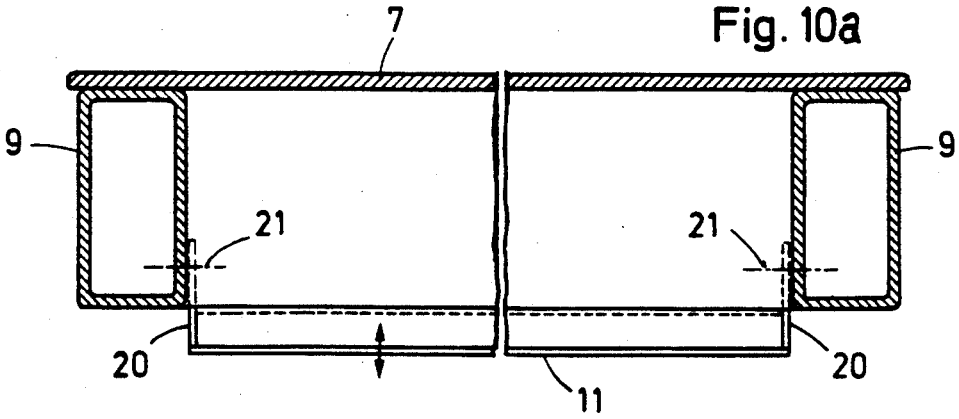

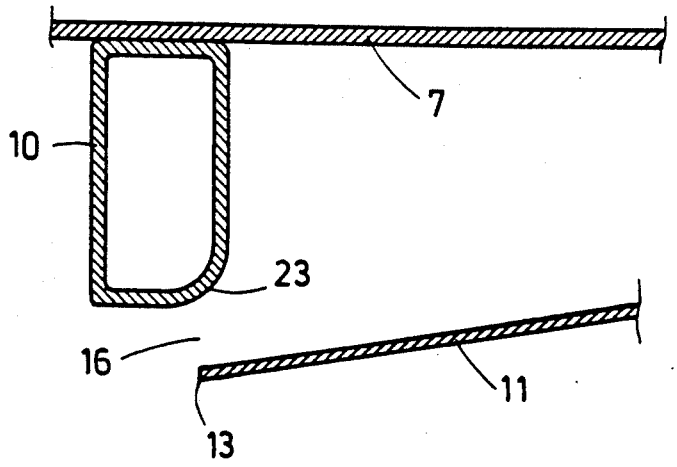
Fig. 11
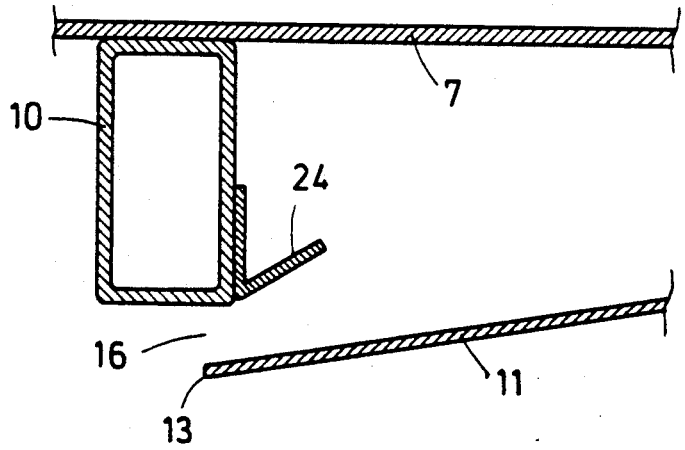
Fig. 12
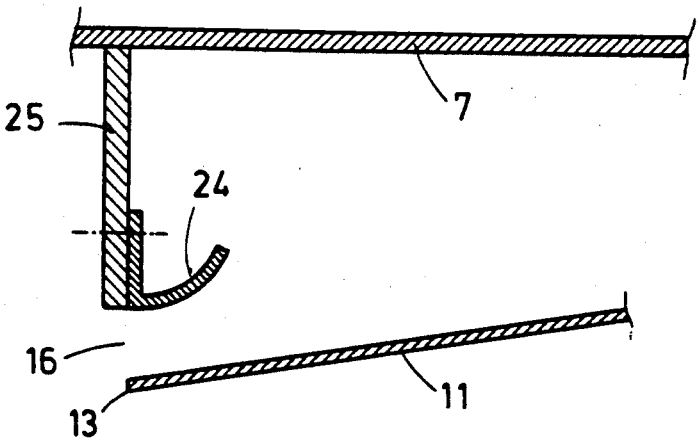
Fig. 13
Fig. 14
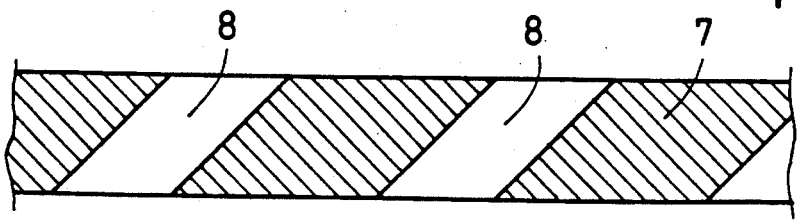

DOUBLE FLOOR FOR REMOVING AIR FROM ROOMS

This is a continuation of Ser. No. 07/270,956, filed Nov. 14, 1988, abandoned.

BACKGROUND OF THE INVENTION

1. Field of the Invention

The present invention relates to a double floor or double bottom for removing air from rooms, particularly clean rooms, which are connected to the air supply system of a ventilating and/or air-conditioning unit. The present invention particularly relates to a double floor in which the upper floor plane is formed by perforated plates with holes and/or slots. The perforated plates are supported by support members. On the underside of the perforated plates is provided a stiffening system composed of stiffening webs, stiffening sections or the like.

2. Description of the Related Art

When double floors of the above-described type are used in rooms, particularly clean rooms, large quantities of air are conducted vertically from the top into the room and are subsequently drawn off from below through the double floor.

The air flow is laterally deflected in the double floor underneath the perforated plates and is drawn off from the double floor at one or more sides of the room.

When air is conducted through the room in this manner, it is particularly important to achieve a distribution of the air which is as uniform as possible over the entire cross-sectional area of flow within the room. Such a uniform distribution can be achieved when the space within the double floor, i.e., underneath the perforated plates, can be dimensioned sufficiently high or when the free cross-sectional area of the double floor is very small.

Experience has shown that a uniform distribution can be achieved when the free cross-sectional area of the area of passage through the double floor corresponds approximately to the cross-sectional area available for moving the air from the double floor area.

The air flow can also be made uniform within certain limits by providing different free cross-sectional areas in the perforated plates, particularly by varying or differently arranging the shape, size, location or arrangement of the holes and/or slots in the perforated plates.

The reduction of the free cross-sectional area is limited by the pressure losses in the floor. However, such pressure losses are undesirable because they lead to an increase in energy costs. For example, a pressure loss of 200 Pa in the double floor already corresponds to a power of approximately 90 $W/m^2$.

It is, therefore, the primary object of the present invention to provide a double floor of the above-described type in which a uniform distribution of the air drawn off over the surface of the double floor is achieved while the pressure loss is low to average.

SUMMARY OF THE INVENTION

In accordance with the present invention, cover members are provided on the portions of the stiffening system facing away from the perforated plates. The cover members form at least in the regions of the edges of the stiffening webs or sections nozzle openings which project beyond the lower plane of the stiffening system. All nozzle openings open in the same direction.

The features provided in accordance with the present invention make it possible to substantially reduce the pressure loss in the double floor. This is because the underside of the perforated plates with the stiffening system has a smooth configuration. However, the remaining pressure loss in flow direction is compensated by the fact that the air is blown in with greater power. Thus, if the velocity of the partial flows which flow in an inclined direction is greater than that of the main flow, the partial flows transfer a large portion of their power in main flowing coefficients of friction for the main flow which compensate for the remaining pressure loss.

In accordance with a further development of the present invention, a baffle plate of laminated material is provided for always two stiffening webs, stiffening sections or the like arranged parallel spaced apart within the stiffening system. One longitudinal side edge of the baffle plate is connected to one of the stiffening webs, stiffening sections or the like, while the other longitudinal side edge of the baffle plate is located spaced apart from the lower edge of the second adjacent stiffening web, stiffening section or the like.

As a result of the above-described development, a propelling nozzle system is created in a simple manner which operates with as shallow an angle as possible relative to the main flow direction. This, in turn, has the consequence that the partial volume flows are introduced into the discharge duct with high velocity, so that a relatively great pressure drop is produced at the inlet, on the one hand, and a portion of the dynamic energy of the partial flow can be used for propelling the main flow, on the other hand.

In accordance with another further development of the double floor according to the present invention, the longitudinal side edges of adjacent baffle plates may each be arranged in the region of a stiffening web, stiffening section or the like in such a way that they overlap each other in a scale-like fashion.

As a result, the directional effect of the propelling nozzles for the partial volume flows entering the double floor is particularly favorably influenced.

In accordance with another feature of the invention, the cover members are formed for all stiffening webs, stiffening sections or the like of a perforated plate by a common plate which, in the spaces between adjacent stiffening webs, stiffening sections or the like, is provided with nozzle slots punched into the plate or embossed scoop-like in the plate.

In accordance with another feature, the common plate may be provided with a row of nozzle slots at least near and extending parallel to each stiffening web, stiffening section or the like.

Also, it is possible to provide the common plate with a row of nozzle slots at least in the middle between and extending parallel to two adjacent stiffening webs, stiffening sections or the like.

However, the two features mentioned above can also be used in combination, so that a row of nozzle slots is provided, on the one hand, near a stiffening web, stiffening section or the like and also between two adjacent stiffening webs, stiffening sections or the like.

In all of the above cases, it has been found particularly useful if, in accordance with another feature of the invention, the scoop-like portions defining the nozzle slots in the common plane have a shallow S-shaped contour in flow direction of the air. This has a favorable directional effect on the partial volume flow.

It has also been found useful in some cases if each baffle plate is suspended between the stiffening webs, stiffening sections or the like so as to be angularly adjustable within certain limits and fixable in different angular positions, so that the angular adjustment of the baffle plates results in a regulation of the air flow quantity.

The operation of the propelling nozzles can always be improved by arranging a flow guide surface in each region of the stiffening webs, stiffening sections or the like adjacent a nozzle opening.

The above-mentioned guide surface can be formed directly by a portion of each stiffening web, stiffening section or the like having an arch-shaped contour. On the other hand, the guide surface may be provided on an additional section which is connected or connectable to each stiffening web, stiffening section or the like.

The various features of novelty which characterize the invention are pointed out with particularity in the claims annexed to and forming a part of this disclosure. For a better understanding of the invention, its operating advantages attained by its use, reference should be had to the drawings and descriptive matter in which there are illustrated and described preferred embodiments of the invention.

BRIEF DESCRIPTION OF THE DRAWING

In the drawing:

FIG. 2 is a top view, on a larger scale, of a perforated plate with holes and/or slots of the double floor shown in FIG. 1;

FIG. 3 is a sectional view, on a larger scale, taken along section line III—III of FIG. 2;

FIG. 4 is a sectional view, on a larger scale, taken along sectional line IV—IV of FIG. 2;

FIG. 7 is a/sectional view corresponding to FIG. 5, showing a modified type of a perforated plate for a double floor according to the present invention;

FIG. 8 is a sectional view taken along sectional line VIII—VIII of FIG. 7;

FIG. 9 is a schematic sectional view of another embodiment of a perforated plate;

FIGS. 11–14 are partial schematic sectional views of different variations of the perforated plates for a double floor for removing air from rooms in accordance with the present invention.

DETAILED DESCRIPTION OF THE INVENTION

Figure 1:
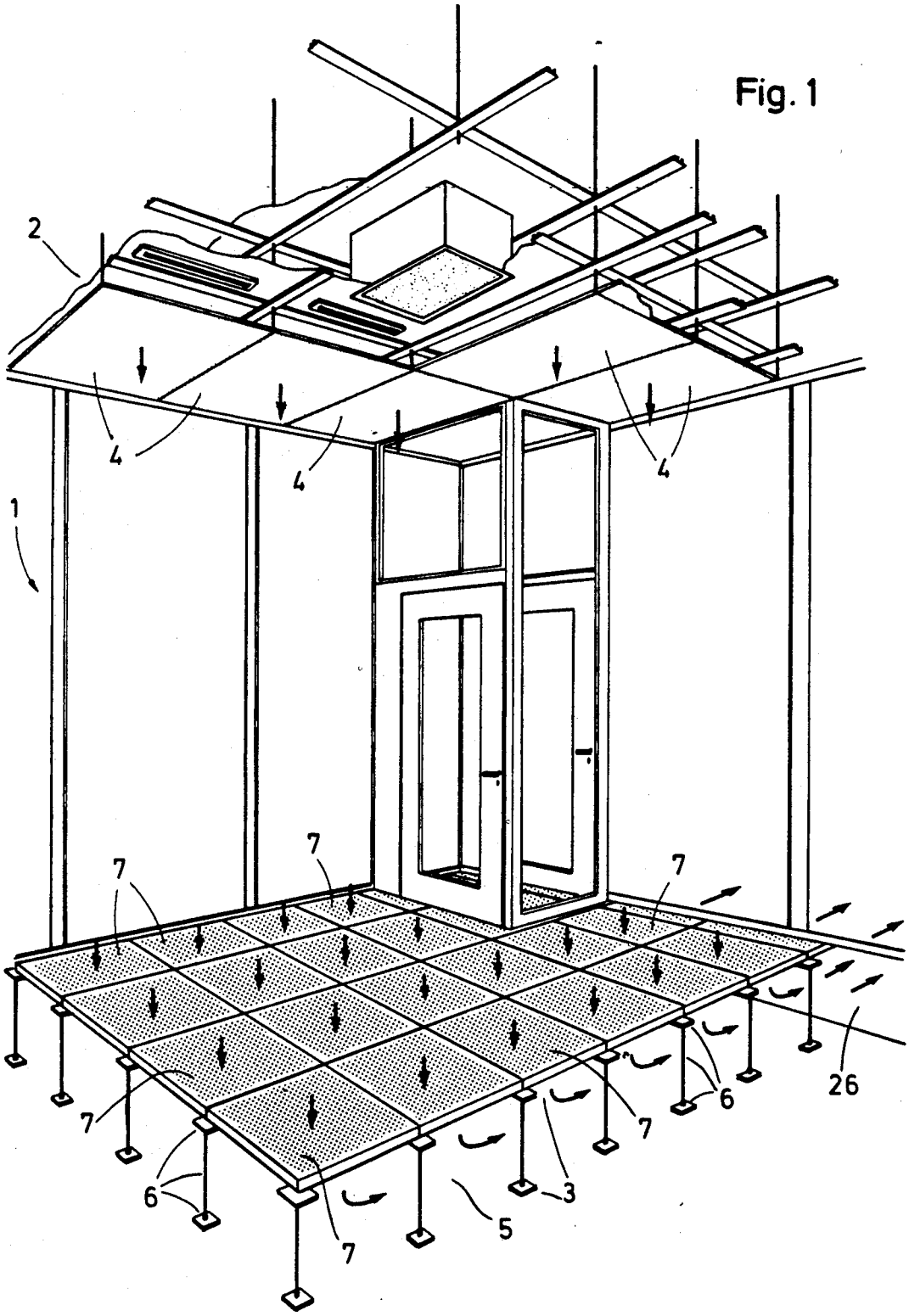
FIG. 1 is an isometrical partial view of a clean room to be ventilated and/or air-conditioned, the clean room being provided with a double floor for removing air in accordance with the present invention.

FIG. 1 of the drawing is an isometrical illustration of a portion of a clean room as it is used, for example, in the manufacture of highly sensitive electronic components, in operating theaters in hospitals or also for accommodating electronic data processing equipment. As a rule, such a clean room supplied with the necessary air by an air-conditioning unit. The air-conditioned air is conducted as a so-called displacement or piston-type flow through the clean room 1 in which the air flows usually in vertical direction from the ceiling 2 toward the floor 3.

To obtain a laminar vertical flow in the clean room 1, ceiling 2 is a so-called climatic ceiling whose lower level is equipped with so-called laminarizators 4.

However, instead of the laminarizators 4, it is also possible to use perforated ceilings or grating-type ceilings. Furthermore, it is possible to use only mechanical filters as outlets if laminar flow of the air is of minor significance.

The bottom 3 of the clean room 1 is a double floor in which, as clearly shown in FIG. 1 of the drawing, a plurality of perforated plates 7 with holes and/or slots are supported spaced above the actual floor 5 of the building by means of support members 6 resting on floor 5.

The support members 6 may be e.g. rod-shaped and are provided with a support plate each at the upper end as well as the lower end thereof.

The support members 6 are arranged and mounted on the floor 5 preferably in such a way that at least the corner regions of the perforated plates 7 rest on the upper support plates of support members 6. Thus, in the corners of a room, the corner of only one perforated plate 7 rests on the upper support plate of a support member 6. The corners of two adjacent perforated plates 7 rest simultaneously on the upper support plates of a support member 6 placed along a wall of the room. Finally, in the areas away from the walls of the room, the support members 6 are arranged on the floor 5 in such a way that the corners of four adjacent perforated plates 7 are placed on the support plate of the support member 6.

Since the perforated plates 7 placed on the support members 6 form the upper level of the double floor 3, it is important for a uniform distribution of the air over the entire cross-section of the room through which the air flows vertically, that the perforated plates 7 ensure corresponding uniform air passage into the double floor 3. Each individual perforated plate 7 has over the surface area thereof a plurality of openings 8 in the form of holes or slots, for example, of equal size, as can be seen in FIGS. 2–4 of the drawing.

To ensure a high load-bearing capability as required for the purpose for which the double floor is to be used, each individual perforated plate 7 rests on a support frame 9 extending closely adjacent all sides of the plate 7 and on a large number of support girders 10 extending parallel and spaced apart from each other. The support girders 10 also stabilize the support frame 9. The support girders 10 are fixedly connected to the support frame 9, for example, by welding, and the connection of the support frame 9 and the support girders 10 with the perforated plate 7 is also e.g. a welded construction.

In the embodiment of the perforated plate 7 shown in FIGS. 2–4, the support frame 9 and the support girders 10 are each formed by rectangular pipes which are placed on the shorter side as seen in cross-section thereof. However, the rectangular pipes forming the support frame have a greater width than the rectangular pipes forming the support girder 10, as can be seen clearly from a comparison of FIGS. 3 and 4.

As illustrated in FIG. 1 of the drawing, the air flows conducted in vertical direction through the perforated plates 7 into the double floor 3 are deflected underneath the perforated plates 7, i.e., within the double floor frame, so that the air flows can be discharged through an air outlet 26 having a relatively large size and located on at least one of the walls of the room.

Figure 5:
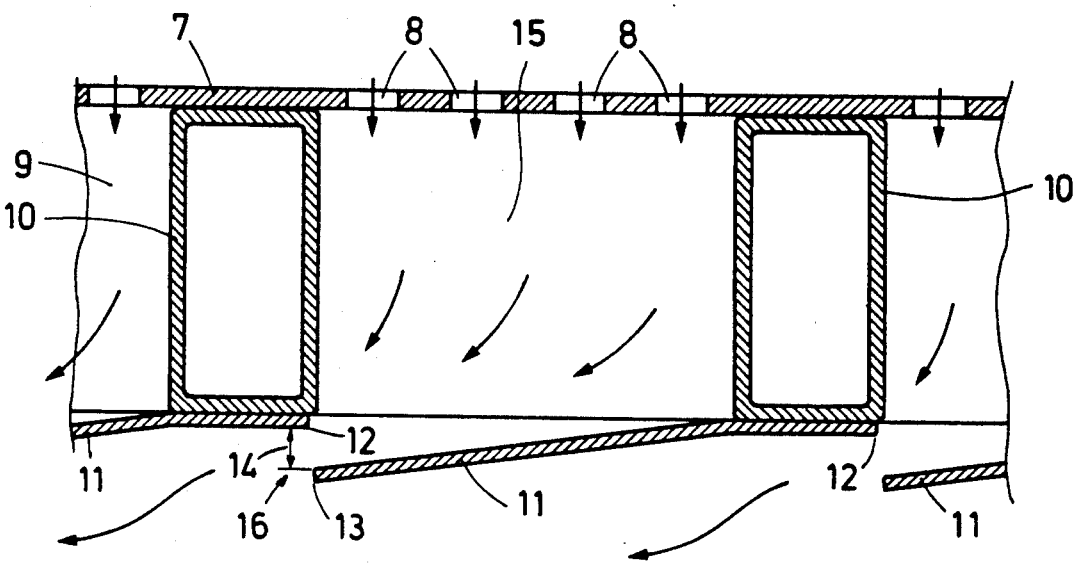
FIG. 5 is a sectional view corresponding to FIG. 4, however, with two spaced-apart, adjacent stiffening sections.

In order to achieve a uniform distribution of the discharged air over the entire surface of the perforated plates 7 of the double floor 3 when an average pressure loss occurs, special features are provided on the individual perforated plates 7, a first embodiment thereof being shown in FIGS. 3–5 of the drawing. The support frame 9 and support girders 10 mentioned above form a stiffening system which determines the load-bearing capabilities of each perforated plate 7.

The portions of the stiffening system facing away from the actual perforated plates 7 are provided with special cover members in the form of thin-walled laminated plates. In the embodiment shown in FIGS. 3–5, these cover members are baffle plates 11. A longitudinal side edge 12 of each baffle plate 11 is connected to either a rectangular pipe of the support frame 9 acting as a stiffening section or to a rectangular pipe of a support girder 10 which also acts as a stiffening section, as can be seen in FIGS. 3–5.

As particularly clearly shown in FIG. 5, the baffle plate 11 is at a distance away from its longitudinal side edge 12 bent at a relatively small angle, so that its other longitudinal side edge 13 is a distance 14 away from the lower edge of the next adjacent stiffening section or rectangular pipe of a support girder 10 or the support frame 9.

As also shown in FIG. 5, each baffle plate 11 preferably overlaps with its free longitudinal side edge 13 the longitudinal side edge 12 of the next following or adjacent baffle plate 11 fastened to a support girder 10 or support frame 9.

Each baffle plate 11 forms the lower cover of a hollow space 15 defined beneath the perforated plate 7 and between two spaced-apart parallel rectangular pipes of the support frame 9 or the support girder 10. Only a longitudinal gap corresponding to the distance 14 is kept free between the free longitudinal side edge 13 of each baffle plate 11 and the adjacent longitudinal surface of a rectangular pipe of a support girder 10 or support frame 9. The longitudinal gap forms a nozzle gap 16 of relatively small width which results in a directed air discharge from the respective hollow space 15 into that space of the double floor 3 which is kept free above the actual floor 5 of the buildings.

Figure 6:
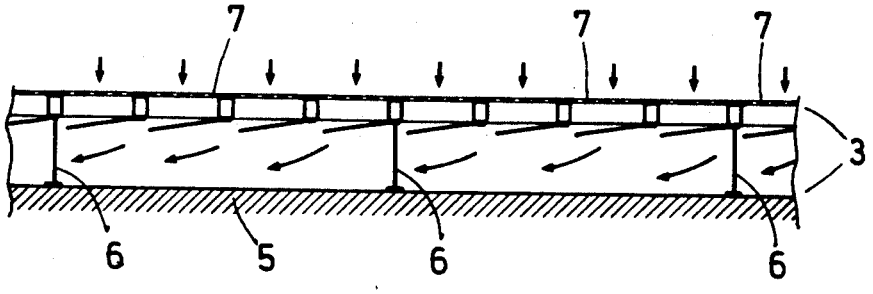
FIG. 6 is a partial schematic sectional view of a double floor with the perforated plates shown in FIGS. 2–5.

The manner of operation of these nozzle gaps acting as propelling nozzles is particularly clearly shown in FIG. 6. In FIG. 6, a large number of perforated plates 7 are arranged next to each other, wherein each perforated plate 7 has at the underside thereof a plurality of baffle plates 11 directed in the same direction, the arrangement and configuration thereof having been extensively described with respect to FIGS. 3–5.

As FIG. 6 of the drawing shows, the partial flows emerging from the individual hollow spaces 15 of each perforated plate 7 through the nozzle gaps 16 formed by the baffle plates 11 enter the hollow space of the double floor 3 above the floor 5 at a very shallow angle relative to the main flow direction. As a result, a relatively large pressure drop at the inlet is produced and, on the other hand, a portion of the dynamic energy of the partial flow is utilized for propelling the main flow.

Thus, when the velocity of the partial flow which flows in at an inclined direction is greater than that of the main flow, the partial flow transfers a large portion of its power in main flowing direction to the main flow. This leads to negative coefficients of friction for the main flow and, consequently, any occurring pressure loss is compensated.

As illustrated in FIGS. 7 and 8, the cover of the hollow spaces 15 between adjacent rectangular pipes of the support frame 9 or the support girders 10 does not necessarily have to consist of individual baffle plates 11.

Rather, as illustrated in FIGS. 7 and 8, the covers formed by a common and continuous plate 17 which extends over all rectangular pipes for stiffening sections of the support frame 9 and support girders 10. In the regions between adjacent rectangular pipes or stiffening sections, the common plate 17 is provided with punched nozzle slots which are then formed in the manner of scoops 18.

The common plate 17 should be provided with a row of nozzle slots 18 located at least near and parallel to the rectangular pipe or stiffening section at the downstream end of the hollow space 15. It would also be possible to provide this one row of nozzle slots 19 in the hollow space 15 approximately in the middle between two parallel rectangular pipes for stiffening sections.

However, the arrangement of nozzle slots illustrated in FIG. 7 has been found particularly advantageous. In that case, each hollow space 15 has two rows of nozzle slots 19, wherein one row of slots 19 is arranged in the region of the downstream rectangular pipe or stiffening section, while the second row of slots 19 is arranged approximately in the middle between two adjacent rectangular pipes or stiffening sections.

FIG. 7 of the drawing further shows that the scoop-like projections 18 defining the nozzle slots 19 in the common plate 17 preferably have a shallow S-shaped contour in flow direction. Thus, it is ensured that the air flows at as shallow an angle as possible relative to the main flow direction from the hollow space 15 into the region of the double floor 3 above the floor 5.

Figure 10B:
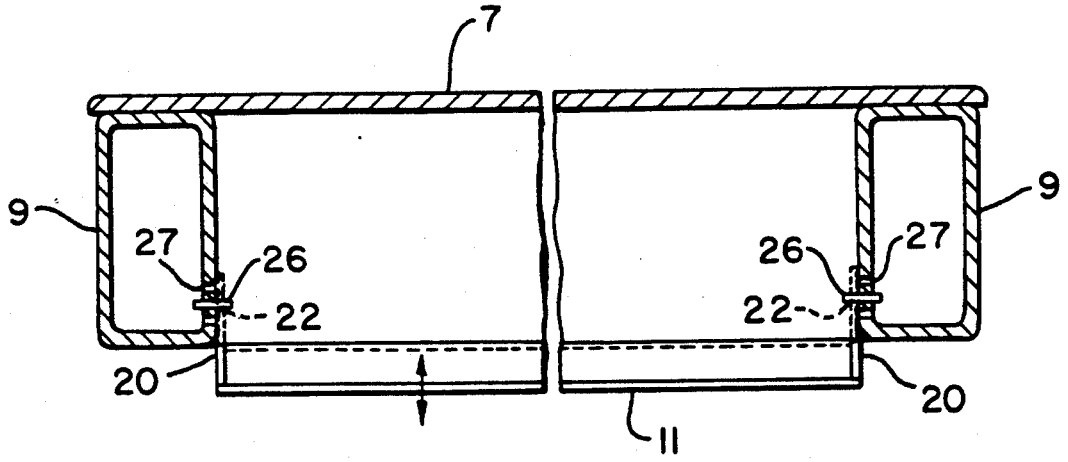
FIG. 10 is a view of the perforated plate of FIG. 9 seen in the direction of arrow X.

Furthermore, FIGS. 9 and 10 of the drawing show that, contrary to the construction of the perforated plates 7 shown in FIGS. 3–5, perforated plates 7 may be provided in the region of each hollow space 15 with a baffle plate 11 which is angularly adjustable within certain limits and can be fixed in different angular positions between two spaced-apart and parallel rectangular pipes or stiffening sections of the support frames 9 and support girders 10.

To make the adjustable baffle plates 11 possible, flanges 20 are bent upwardly at a right angle on both transverse edges of the baffle plates 11. These flanges 20 are suspended by means of bearing pins 21 between two parallel girders of the support frame 9 in the vicinity of the longitudinal side edge 12. Near the longitudinal side edge 13 of the baffle plate 11, the flanges 20 have locking means 22 for connecting the flanges 20 to the support frame 9, so that the respective angular position of the baffle plate 11 relative to the support frame 9 can be fixed.

By changing and subsequently fixing the angular position of the baffle plates 11 in the example according to FIGS. 9 and 10, it is possible in a simple manner to adjust the size of the nozzle gap 16 and, thus, a control of the quantity of the air flowing from the hollow space 15 through the nozzle gap 16 can be achieved.

Furthermore, it is possible in a simple manner to influence the contour of the nozzle gap 16 between the longitudinal side edge 13 of the baffle plate 11 and the adjacent rectangular pipe of a support girder 10 or support frame 9. For example, it is possible to provide the corner of the rectangular pipe on the inflow side with a rounded-off portion 23, as shown in FIG. 11. As a result, a flow guide surface is formed which advantageously influences the air passage through the nozzle gap 16.

A similar effect can be obtained by using an additional section 24 which is subsequently connected to the rectangular pipe of a support girder 10 or support frame 9, as shown in FIG. 12 of the drawing. A similar additional section 24 for influencing the contour of the nozzle gap 16 is also shown in FIG. 13 of the drawing. However, in that case, the stiffening system of the perforated plate 7 is not formed by rectangular pipes. However, as shown in FIG. 13, it may be sufficient to form the support frame 9 and the support girders 10 of the stiffening system by flat material members 25 which are arranged on edge and are fastened to the bottom side of the perforated plate 7.

Finally, FIG. 14 of the drawing shows that the perforated plates 7 may also be constructed as single-piece, thick-walled members. The openings 8, either in the form of round holes or as longitudinal slots, can be out into the plates at a relatively shallow angle, so that the shallow inlet angle for the partial flows relative to the main flow direction is achieved in the double floor 3 to obtain a low pressure loss.

While specific embodiments of the invention have been shown and described in detail to illustrate the application of the inventive principles, it will be understood that the invention may be embodied otherwise without departing from such principles.

I claim:

1. In a double floor used in a system for removing air from a room which is connected to an air supply system of a ventilating or air-conditioning system, the room having a floor, the double floor being supported by a plurality of support members so that a hollow space is defined between the double floor and the floor of room, the double floor including an upper floor plane and a lower floor plane, the upper floor plane being formed by perforated plates, a stiffening system composed of spaced-apart stiffening members being mounted between the upper and lower floor planes, the improvement comprising the lower floor plane comprising at least one baffle plate in each space between stiffening members, each baffle plate having longitudinal side edges, one of the longitudinal side edges being mounted in the lower floor plane of the double floor, the other of the longitudinal side edges being spaced from the lower floor plane and being located below the lower floor plane and above the floor of the room, so that the baffle plates define with the lower floor plane a plurality of nozzle openings, wherein the nozzle openings open into the hollow space in the same direction, wherein the longitudinal side edges of adjacent baffle plates are arranged so as to overlap each other in a scale-like manner at a stiffening member.

2. The double floor according to claim 1, wherein the perforated plates have holes.

3. The double floor according to claim 1, wherein the perforated plates have slots.

4. The double floor according to claim 1, wherein the stiffening members are stiffening webs or stiffening sections.

5. The double floor according to claim 1, wherein the baffle plate is of laminated material.

6. The double floor according to claim 1, wherein the baffle plates are formed for all stiffening members by a common plate which defines nozzle slots in the plate in the spaces between adjacent stiffening members.

7. The double floor according to claim 6, wherein the nozzle slots are punched into the common plate.

8. The double floor according to claim 6, wherein the nozzle slots are embossed scoop-like in the common plate.

9. The double floor according to claim 5, wherein a row of nozzle slots is formed at least near and extending parallel to the stiffening member.

10. The double floor according to claim 6, wherein a row of nozzle slots is provided at least in the middle between and extending parallel to two adjacent stiffening members.

11. The double floor according to claim 8, wherein the scoop-like nozzle slots have a shallow S-shaped contour in flow direction of the air.

12. The double floor according to claim 1, wherein a flow guide surface is provided in each region of a stiffening member adjacent a nozzle opening.

13. The double floor according to claim 12, wherein the guide surface is formed by a portion of a stiffening member having an arch-shaped contour.

14. The double floor according to claim 12, wherein the guide surface is provided on an additional section, the additional section being connected to the stiffening member.

* * * * *